US005130503A

United States Patent [19]

Heiress

[11] Patent Number: 5,130,503

[45] Date of Patent: Jul. 14, 1992

[54] PRESSURE WAVE SWITCH HAVING IMPROVED CONTACT STRUCTURE AND PRESSURE EQUILIZATION

[75] Inventor: Steven J. Heiress, Chicago, Ill.

[73] Assignee: Mark IV Transportation Products Corporation, Chicago, Ill.

[21] Appl. No.: 708,550

[22] Filed: Jun. 24, 1991

[51] Int. Cl.[5] ..... H01H 35/34

[52] U.S. Cl. ..... 200/83 N; 200/61.7; 200/835

[58] Field of Search ..... 200/61.7, 64.43, 61.76, 200/51 R, 81 H, 302.1, 83 R, 83 S, 83 SA, 83 N, 83 Q, 83 Z, 81.4; 307/118; 340/626; 73/717, 723, 729; 91/1; 92/5 R

[56] References Cited

U.S. PATENT DOCUMENTS

| | | | |
|---|---|---|---|
| 3,303,303 | 2/1967 | Miller | 200/61.43 |
| 3,862,387 | 1/1975 | Phillips et al. | 200/83 |
| 3,911,393 | 10/1975 | Biggs | 200/83 N |
| 4,133,365 | 1/1979 | Schleicher | 160/118 |
| 4,140,436 | 2/1979 | Schumacher | 417/27 |
| 4,211,901 | 7/1980 | Matsuda | 200/83 B |
| 4,238,651 | 12/1980 | Tann | 200/83 P |
| 4,535,209 | 8/1985 | Kurz | 200/83 |
| 4,614,849 | 9/1986 | Miller | 200/81 |
| 4,620,072 | 10/1986 | Miller | 200/81 R |

OTHER PUBLICATIONS

Bircher Technical Data (4 sheets) 1972 Catalog Excerpt.

*Primary Examiner*—Gerald P. Tolin
*Attorney, Agent, or Firm*—Francis J. Lidd

[57] ABSTRACT

An improved pressure switch of the pulse or pressure wave sensitive type includes a switch housing with an internal diaphragm chamber. A relief vent with a fixed orifice disk is provided in the diaphragm chamber. A diaphragm is mounted in the diaphragm chamber which includes an electrical contact mounted on and movable with the diaphragm. An adjustable contact is threaded through a tapped terminal link in the switch housing to position a contact surface on the adjustable contact adjacent to the electrical contact mounted on the diaphragm. The adjustable contact includes a slotted end. A slotted, round lock nut is threaded on the adjustable contact. To provide an electrically reliable contact, a biasing member is positioned between the round lock nut and the tapped terminal link providing a positive thread bias on the contacting threads of the adjustable contact and the terminal link. A tool for adjusting the position of the contact surface relative to the electrical contact mounted on the diaphragm is also disclosed. The tool engages and rotates the adjustable contact while maintaining the positions of the round lock nut and the terminal link stationary. By using the tool, the positive biasing force on the contacting threads does not change. The tool includes an elongated blade member extending through a coaxial tubular member. The tubular member includes a pair of fingers configured to engage the slot of the round lock but while the blade member engages and rotates the adjustable contact.

18 Claims, 4 Drawing Sheets

PRESSURE WAVE SWITCH HAVING IMPROVED CONTACT STRUCTURE AND PRESSURE EQUILIZATION

FIELD OF THE INVENTION

The present invention relates to a new and improved device for applying a positive biasing force between contacting threads of an adjustable contact and a terminal link in a pressure wave switch and for maintaining this biasing force constant during and after adjustment of the adjustable contact; and to a new and improved method for adjusting an adjustable contact threaded in a terminal link of a pressure wave switch while maintaining a constant, positive biasing force on the threads of the contact and terminal link.

DESCRIPTION OF THE BACKGROUND ART

Modern mass transit door systems typically employ a fluid or pneumatically operated obstruction sensing system which is secured to the leading edge of an automatic door. The most popular system is the pneumatic operating sensing arrangement. Examples of two types of these systems are disclosed in U.S. Pat. Nos. 4,133,365 and 3,303,303, incorporated by reference herein.

Typical arrangements employ a soft hollow extruded rubber or other elastomeric edge that is air tight except for a sensing tube extending from a hollow interior of the edge to a remotely located pressure wave switch. The pressure wave switch includes a diaphragm mounted in a pressure chamber. Switch contacts are mounted on the diaphragm and the pressure chamber. The chamber in the sensing edge is a large relative to the pressure chamber in the pressure wave switch such that the switch is highly sensitive to differential volume variations or changes in the shape of the leading edge. For example, if an arm of a passenger were engaged by the sensing edge, the change in configuration of the chamber in the edge would send a pressure pulse through the sensing tube that is sensed in the pressure chamber in the switch. This pressure pulse causes the diaphragm to flex and the switch contacts to engage, actuating the switch to recycle the system and open the door.

Although existing pressure wave switches generally provide adequate operation, substantial problems arise in the reliability of the electrical contact areas of the switch. Since engagement of the sensitive edges of the doors with a vehicle passenger is utilized to actuate the pressure wave switch and prevent further closure of the door, the importance of reliability of the switch contacts cannot be over estimated.

Switch contact problems experienced by pressure wave switches most commonly in use today arise from the adjusting feature of the adjustable contact included in the switch. The adjustable contact includes threads allowing the contact to be threaded into a tapped terminal link. Since thread engagement between the adjustable contact and terminal link carries the signal current indicating engagement of the vehicle door sensitive edge with an obstruction, it is necessary that the mating surfaces of these threads be maintained in intimate contact.

It has been determined that normal thread tolerances and adjustment requirements of the adjustable contact, often after a period of time, result in the development of high resistance resulting in malfunction of the door edge obstruction sensing function. High resistance can also occur in existing switches since there is no thread bias on the adjustable contact. The adjustment requirements and lack of thread bias result in discontinuity in the threads, and due to low mechanical pressure on the threads, oxidation occurs producing further discontinuity. Reliability of mass transit door systems can be beneficially increased by maintaining mechanical engagement of the terminal link threads with the threads of the adjustable contact.

Additional problems in existing pressure wave switches can occur in a fixed orifice located in a relief vent in the switch housing communicating the pressure chamber with atmosphere. The orifice controls flow through the relief vent allowing the pressure pulse introduced into the pressure chamber upon contact of the elastomeric door edge with an obstruction to flex the diaphragm and actuate the switch. The pressure in the chamber is then vented allowing the diaphragm to reset. The orifice must remain open and clear during the service life of the switch since a clogged orifice will prevent resetting of the diaphragm and malfunctioning of the switch. Typical prior art fixed orifices are not self-cleaning and vapors passing through the fixed orifice tend to condense and particles become lodged, clogging the orifice. Once the orifice is clogged, the diaphragm will not reset and the switch fails to perform its intended function. It is desirable to provide a self-cleaning, fixed orifice thereby extending the service life and increasing the reliability of the switch.

SUMMARY OF THE INVENTION

An object of the present invention is to provide a new and improved switch for a mass transit vehicle door system.

Another object of the present invention is to provide a new and improved pressure wave switch for a mass transit vehicle door system that provides increased reliability by maintaining a positive biasing pressure on the threads of the adjustable contact and terminal of the switch.

A further object of the present invention is to provide a new and improved pressure wave switch for a mass transit vehicle door system that includes an adjustable contact threaded into a terminal and a biasing element for providing a positive biasing force between the threads of the contact and terminal.

Still another object of the present invention is to provide a new and improved method of applying a positive biasing force on the threads of an adjustable contact and a terminal of a pressure wave switch and to maintain this force constant during and after adjusting the contact.

Another object of the present invention is to provide a new and improved tool for adjusting contact closing pressure setting in a pressure wave switch while not disturbing the setting through use of biasing force applied to the threads of the contact and a terminal into which the contact is threaded.

A still further object of the present invention is to provide a new and improved self-cleaning, fixed orifice for a pressure wave switch.

Briefly, the present invention is directed to a pressure wave switch employed to control a motor in an electrically operated transit vehicle door system. The door system includes a bifolding door with an obstruction sensing edge. Typically, when the obstruction sensing edge engages an obstruction, the pressure wave switch is actuated, the actuation signal reverses the motor and recycles a bifolding door. Although, other power operated doors, such as sliding or plug types, can utilize the invention as disclosed. The obstruction sensing edge includes an internal fluid chamber that is in fluid communication with a diaphragm chamber in the pressure wave switch. A pressure sensitive, movable diaphragm carrying an electrical contact is mounted in the diaphragm chamber dividing the diaphragm chamber into first and second chamber portions. The first diaphragm chamber portion is in fluid communication with the internal fluid chamber of the obstruction sensing edge through an inlet and in communication with exhaust through an outlet orifice or relief vent. A self-cleaning, fixed orifice disk is positioned in the outlet orifice to control the rate of exhaust out of the first diaphragm chamber portion allowing actuation of the switch and resetting of the diaphragm.

A threaded, adjustable contact is mounted in the switch. The adjustable contact includes a contact surface extending into the second diaphragm chamber portion adjacent the electrical contact on the diaphragm. The position of the contact surface relative to the contact on the diaphragm may be adjusted by threading the adjustable contact into or out of a tapped terminal link mounted in the pressure wave switch.

As those skilled in the mechanical arts are aware, a threaded engagement between a threaded contact and a mating threaded surface is highly sensitive to the tolerances of both the receiving member and the threaded contact. This variation in tolerances is known as the threaded fit between the members. It is also well known to those skilled in the electrical art that threaded members provide notoriously poor electrical contact surfaces in that any relative motion interrupts the current flow resulting in local heating and/or arcing at the threaded interface representing the contact surfaces. Further, without adequate thread bias, it is well known that contacts of this type are subject to corrosion due to action by the elements further reducing the reliability of a threadably engaged electrical contact. These problems are overcome in the present invention through use of a concentric lock member threaded on the adjustable contact and a compression member mounted between the lock member and the tapped terminal link.

A special tool is used to prevent rotation of a lock nut and maintain the axial pressure provided by the compression member on the threads of the contact and terminal link while the contact is adjusted to close the electrical contacts at the desired switching pressure. By maintaining axial pressure between the terminal link and the adjustable contact, the disclosed structure creates a continuous high pressure line contact at the threaded interface, resulting in a highly reliable electrical connection, thereby substantially improving overall switch reliability.

BRIEF DESCRIPTION OF THE DRAWINGS

The above and other objects and advantages and novel features of the present invention will become apparent from the following detailed description of preferred and alternative embodiments of the invention illustrated in the accompanying drawings wherein.

DESCRIPTION OF THE PREFERRED EMBODIMENTS

Figure 2:
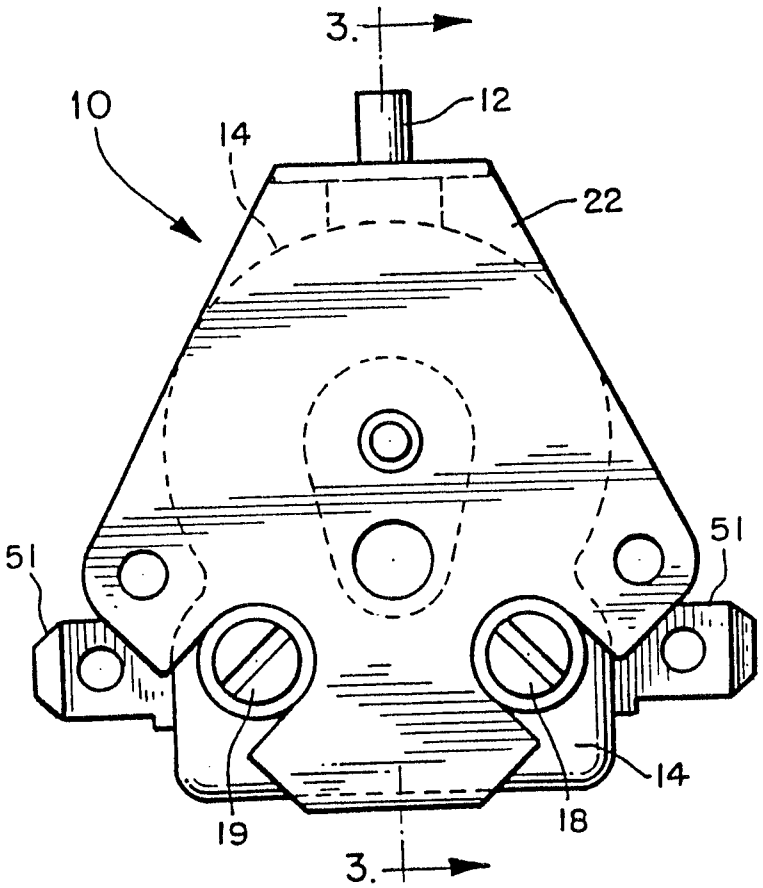
FIG. 2 is a view generally taken along line 2—2 of FIG. 1.
Figure 1:
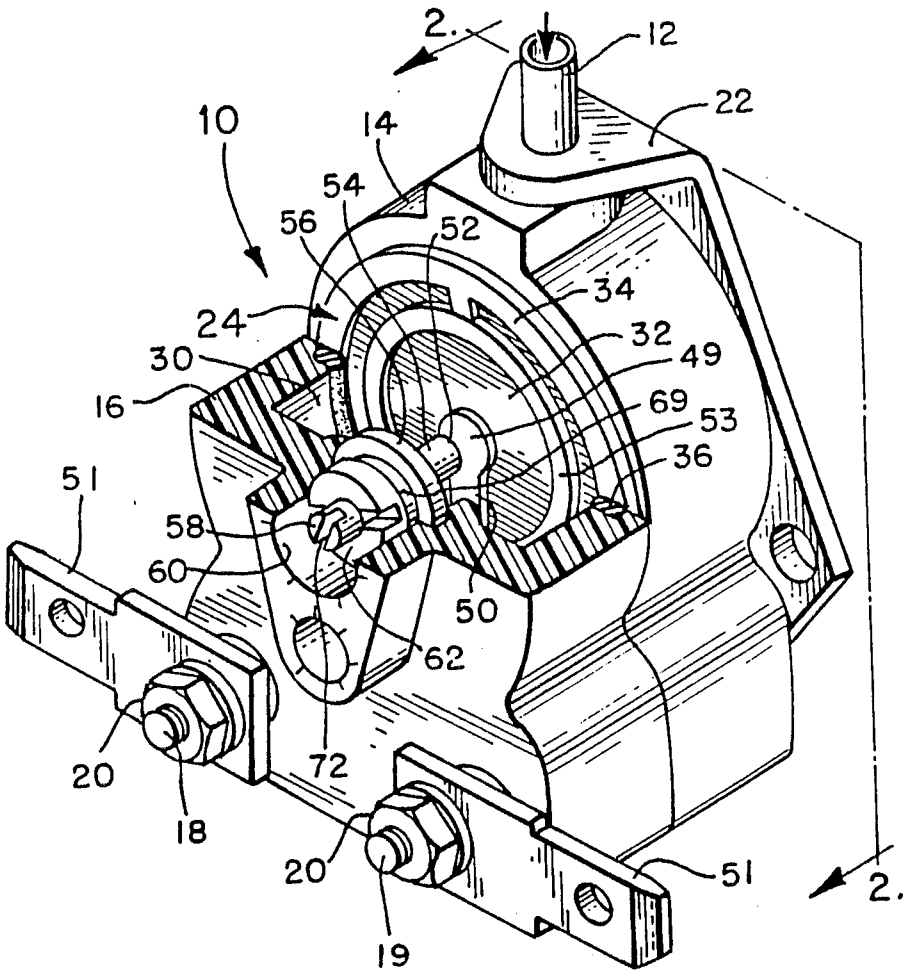
FIG. 1 is a partially cut-away, perspective view of a pressure wave switch constructed in accordance with the principles of the present invention.

Referring to the drawings and initially to FIG. 1, there is illustrated a pressure wave switch 10 constructed in accordance with the principles of the present invention. Pressure wave switch 10 is of a type used to control a motor in a mass transit vehicle door system. The mass transit vehicle door system includes bifolding doors with a fluid or pneumatically operated obstruction sensing system including a leading edge on the doors. Examples of these systems are provided in U.S. Pat. Nos. 4,133,365 and 3,303,303, incorporated herein by reference. The leading edge on these doors is of a soft hollow extruded rubber or similar elastomeric material that is air tight except for a sensing tube 12 extending to the pressure wave switch 10. If an obstruction engages the leading edge of the bifolding door, a pressure pulse is transmitted by tube 12 to switch 10. Switch 10 responds by reversing the motor closing the door, thereby opening the door.

Switch 10 is defined by a first housing portion 14 and a second housing portion 16. When switch 10 is assembled, first housing portion 14 and second housing portion 16 are secured together by fasteners 18 and 19, and nuts 20 to define a unitary switch housing or casing that may be secured to a stationary surface by a mounting plate 22. Mounting plate 22 can be rigidly fixed to first housing portion 14.

Pressure wave switch 10 is a diaphragm type switch with a diaphragm assembly 24 mounted in a diaphragm chamber 26. Diaphragm chamber 26 is defined by a first diaphragm chamber section 28 formed in first housing portion 14 and a second diaphragm chamber section 30 formed in second housing portion 16.

Figures 3, 4, 5, 6:
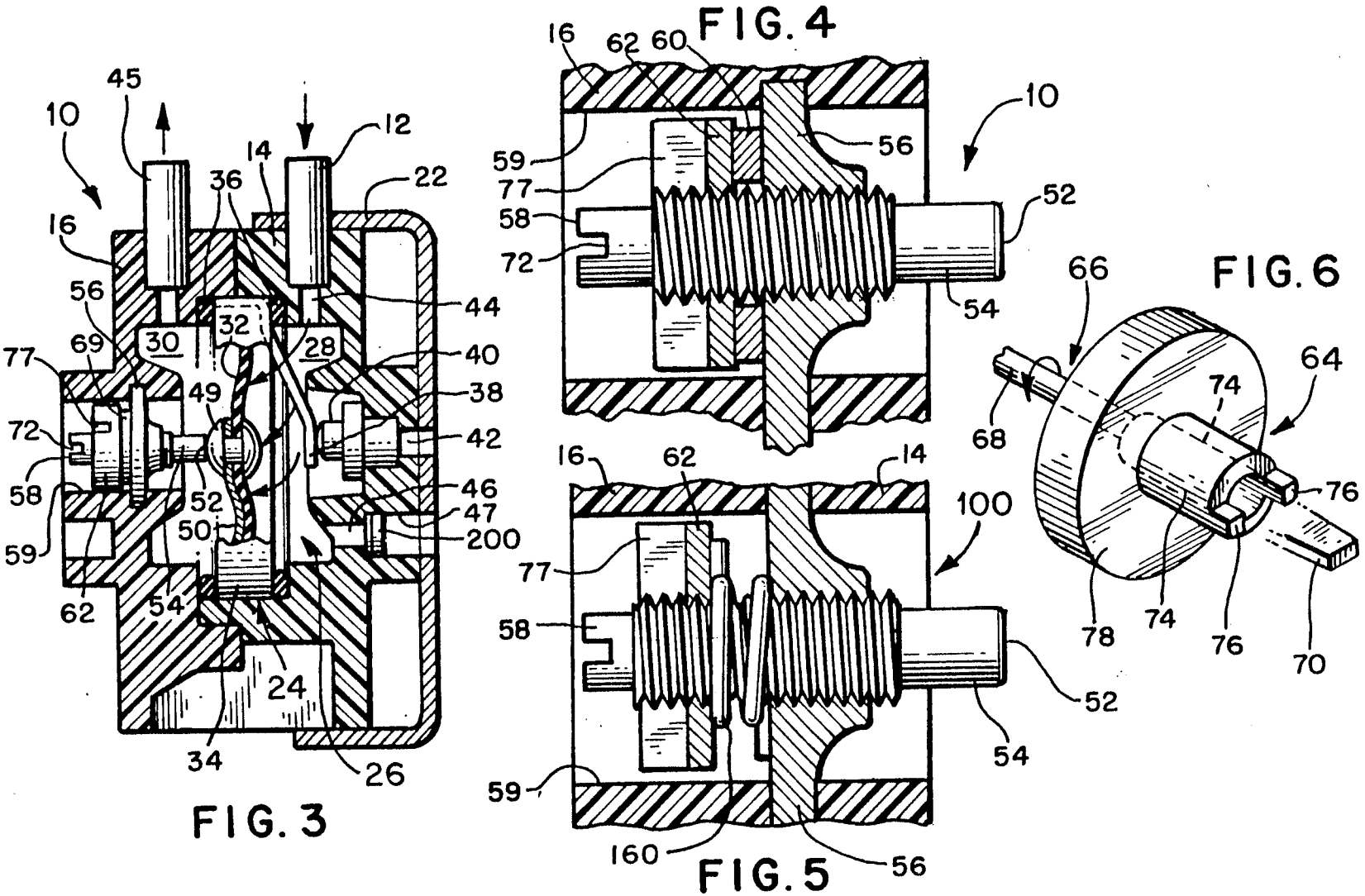
FIG. 3 is a view generally taken along line 3—3 of FIG. 2.
FIG. 4 a partial, cross-sectional view of an adjustable contact and a coaxial biasing member of the present invention.
FIG. 5 is a view similar to FIG. 4 illustrating an alternative embodiment of the biasing member.
FIG. 6 is a perspective view of a tool for adjusting the adjustable contact of the present invention with portions of the tool shown in dotted lines for illustrative purposes.

Diaphragm assembly 24 includes a flexible diaphragm 32 secured at its outer edge or rim to a diaphragm casing 34. To assemble switch 10, first housing portion 14 and second housing portion 16 are secured together by fasteners 18 and 19 and nuts 20 capturing diaphragm casing 34 in diaphragm chamber 26 (FIG. 3). Diaphragm casing 34 is sealed in position, and diaphragm chamber 26 is pneumatically sealed by a pair of seals 36.

To provide an electrical connection from the terminals to flexible connection 50 and movable contact 49, a circular conductor 53 is attached to movable contact 49. A spring 38 mounted in diaphragm casing provides electrical contact with diaphragm or movable contact 49 through conductor 53 and conductor 50 is achieved by spring contact 38 and contact 40. Contact 40 is threadably mounted in housing 14 for contact pressure adjustment between of contacts 38 and 40.

In order for pressure wave switch 10 to sense engagement of an obstruction with a leading edge of a transit vehicle door, sensing tube 12 is in communication with first diaphragm chamber section 28 through a passage 44 formed in first housing portion 14. As illustrated in FIG. 3, engagement of a leading edge of a transit vehicle door with an obstruction will transmit a pressure wave to first diaphragm chamber section 28 which moves or flexes diaphragm 32 and contact 49 in a direction generally toward contact screw 54. To minimize pressure in second diaphragm chamber 30 that could impede movement of diaphragm 32 in response to a pressure pulse in first diaphragm chamber 28, second diaphragm chamber 30 is vented to atmosphere or low pressure through a vent or exhaust tube 45. Vent 45 also serves to equalize the pressure in chamber 30 with ambient atmospheric pressure. Although 45 is shown as an unrestricted passage, use of a controlled orifice in passage 45 is also contemplated.

Flexing of diaphragm 32 functions as a switch controlling operation of the transit vehicle door. An electrical contact 49 and flexible connection 50 are secured to diaphragm 32 and each are electrically connected to external terminal links 51. When installed, external terminal links 51 are electrically connected to a reversing relay to reverse the closing of the transit vehicle door if the sensing edge on the door engages an obstruction.

If the transit vehicle door engages an obstruction, the resulting pressure pulse or wave flexes diaphragm 32 moving electrical contact 49 into engagement with a contact surface 52 of a threaded, adjustable contact 54. Adjustable contact 54 is threaded into a tapped terminal link 56.

To adjust the pressure level of switch contacts 54 and 49, adjustable contact 54 includes a slotted head 72 and is mounted in an aperture 59 allowing access to contact end 52. Terminal link 56 is mounted in second housing portion 16 and is electrically connected to one of the external terminals 51.

Figure 7:
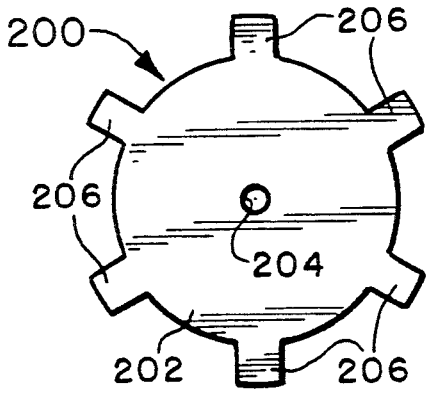
FIG. 7 is a plan view of a fixed orifice disk constructed in accordance with the principles of the present invention.
Figure 8:
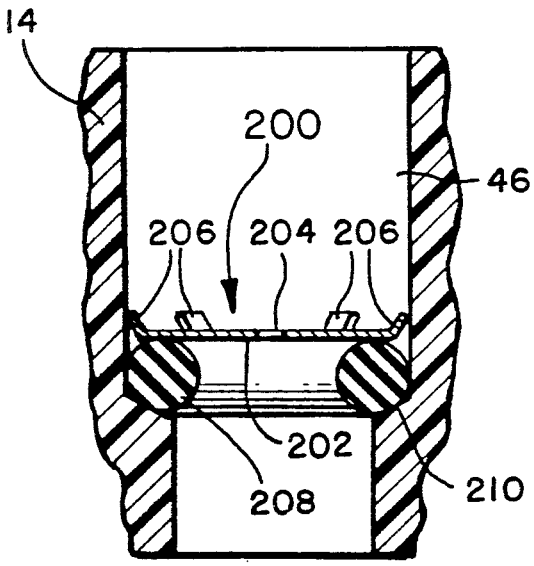
FIG. 8 is a vertical, cross-sectional view of the fixed orifice disk illustrated in FIG. 7 mounted in the housing of the switch illustrated in FIG. 1.

Engagement of contact 54 with contact surface 49 energizes the reversing door motor relay to recycle the doors. Once this occurs, the diaphragm 32 must reset, a vent port 46 is formed in first housing portion 14 providing restricted flow communication of first diaphragm chamber section 28 with the atmosphere. Flow through vent port 46 is restricted and controlled by a fixed orifice disk 200 (FIGS. 3, 7 and 8). Fixed orifice disk 200 controls the timing of the action of the diaphragm 32. As a pressure pulse is introduced into the first diaphragm chamber section 28, fixed orifice disk 200 chokes the flow through the vent port 46 to allow sufficient pressure to build up to flex diaphragm 32 and actuate switch 10. Once this build-up occurs, the diaphragm 32 is allowed to reset as fixed orifice disk 200 leaks pressure out of first diaphragm chamber section 28.

To perform the choking and leaking functions, fixed orifice disk 200 must make the chamber section 28 pressure rate sensitive. The orifice disk must also be self-cleaning since the environmental conditions experienced by the fixed orifice disk 200 are the same as that of an inner wall of a bus or rail transit car passenger section. In this location, the fixed orifice disk 200 is exposed to air-carried debris and cleaning solutions used by the transit industry to clean interiors of buses or rail cars. In prior art pressure wave switches, the fixed orifice often becomes clogged, affecting the flow rate through the relief vent. This clogging can prevent resetting of the diaphragm, resulting in failure of the pressure wave switch.

Figure 12:
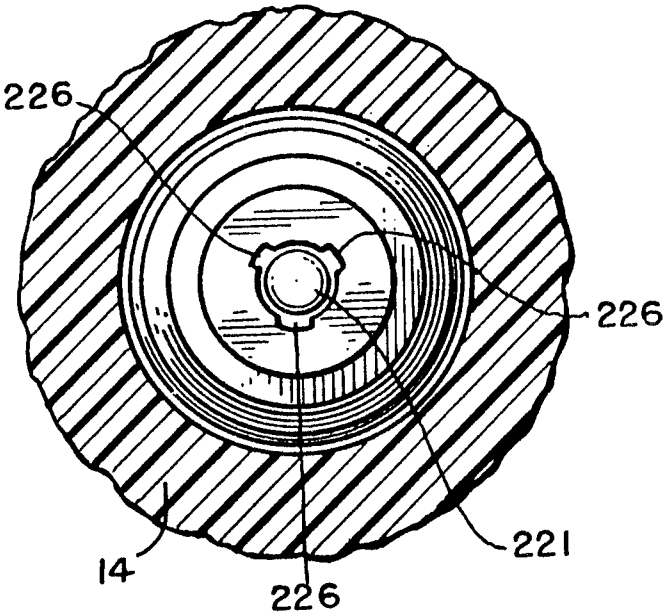
FIG. 12 is a sectional view along the line 12—12 of FIG. 11 showing flow control passages adjacent to a portion of the plug of FIG. 11.
Figure 11:
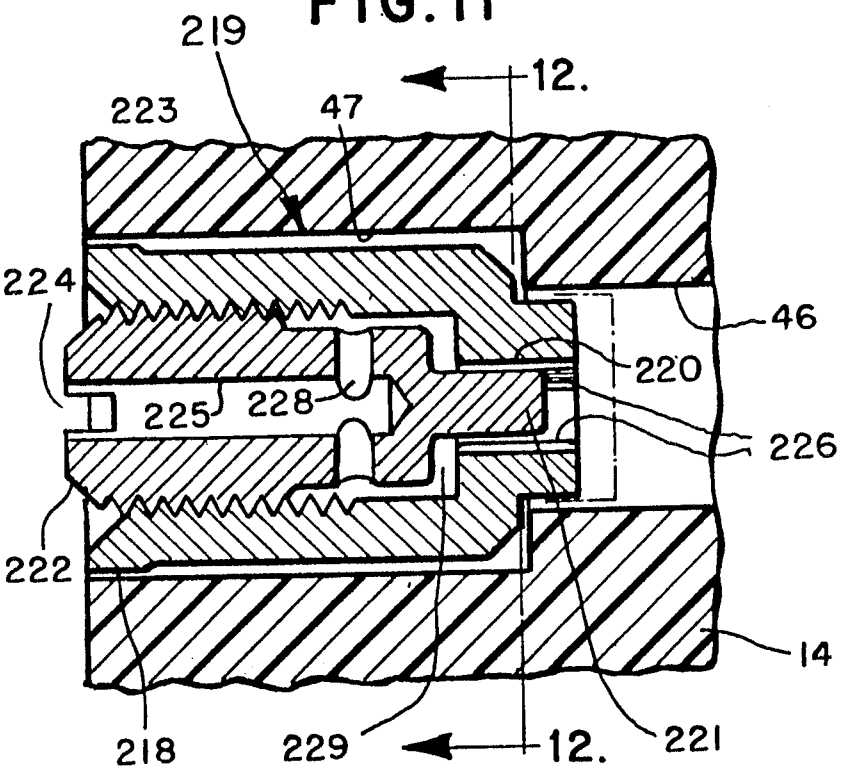
FIG. 11 is a partial section of the vent valve structure of a known pressure wave switch showing an adjustable orifice flow control plug.

A known prior art device utilizes an adjustable equalizing orifice for chamber 28 inserted in passages 46 and 47 (reference FIG. 3). As shown in FIGS. 11 and 12, there is inserted in passages 46 and 47 an adjustable equalizing valve assembly 219. The assembly 219 comprises a semi-deformable body 218 force fitted into the cavity 47, as shown. The body 218 has an internally threaded cavity threadedly engaging a threaded cylindrical insert plug 222. In its shown position, cylindrical insert 222 includes a reduced diameter cylindrical portion 221 occupying a forward internal cylindrical portion of the insert assembly cavity 219, 220.

As best shown in FIG. 12, the reduced diameter cylindrical portion, cavity 220 of the insert 218 incorporates three radially spaced grooves 226 extending through the reduced diameter portion 220 of insert 218. These grooves in cooperation with the extended portion 221 of the threaded plug 222 essentially establish a variable length orifice for atmospheric air flow into an out of cavity 28 of the switch 10.

The adjustable plug 222 further incorporates a longitudinal passage 225 having one end open to the atmosphere and the other end in fluid communication with radial orifices 228. The aforementioned longitudinal radially spaced grooves 226 communicate through an interstice 229 which in turn communicates with the peripheral portions of radial orifice 228.

In operation, rotating the threaded plug 222 through the use of its slotted end 224 moves the plug 222 into and out of the cavity 223 in the insertable plug 218, thereby increasing or decreasing the length of control orifice grooves 226, providing adjustment of the mass air flow between the atmosphere and cavity 28 of the switch 10. This variation essentially controls the reset movement of the flexible diaphragm 32 and its associated movable contact 49.

However, it has been discovered that in practice, the design of this flow control system results in unreliable switch operation and, in many cases, outright switch failure due to orifice contamination, and variation in adjustment due to thermal expansion and contraction of the components making up flow control orifices 226. In particular, in transit vehicle applications such as disclosed in U.S. Pat. No. 4,133,115, when rapid temperature changes are encountered under these conditions, the known switch/orifice combination results in unreliable operation due to the larger volume of air contained in the vehicle's pneumatic door edge. Applicants have further discovered that use of a single fixed orifice of the type disclosed herein dramatically improves switch reliability in use. Further, the use of a single fixed orifice requires no adjustment and in cases of accidental contamination provides an easy to repair, replace or clean the orifice portion of the switch assembly in situ without the need to readjust the orifice, a feature not possible with the known construction.

Fixed orifice disk 200 is self-cleaning and will not normally become clogged over the normal service life of switch 10, thereby increasing the reliability of switch 10. Fixed orifice disk 200 includes a thin body 202 with a central orifice 204. A plurality of tabs or fingers 206 are formed on and extend radially out from body 202. These tabs 206 engage the first housing portion 14, securing fixed orifice disk 200 in the relief vent 46 (FIG. 8). Fixed orifice disk 200 is installed in relief vent 46 on an O-ring 208 positioned on an inclined wall 210 formed in the relief vent 46. In this position, flow can occur only through orifice 204.

Orifice disk 200 is preferably manufactured by a photo-etching process that provides tolerances in the order of plus or minus 0.0005 inch maximum. This design of orifice disk 200 is less subject to long-term contamination or clogging during the service life of switch 10.

Figure 9:
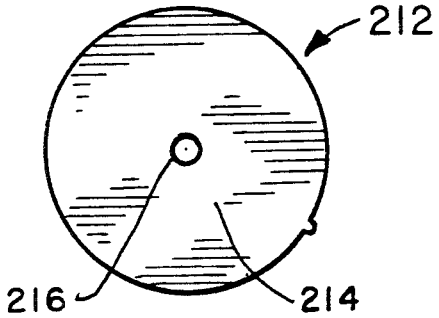
FIG. 9 is a plan view of an alternative embodiment of a fixed orifice disk.
Figure 10:
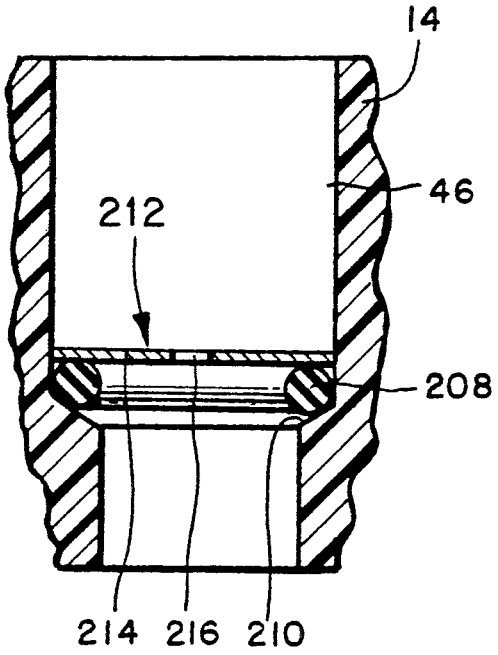
FIG. 10 is a view similar to FIG. 8 of the alternative fixed orifice disk.

An alternative fixed orifice disk 212 is illustrated in FIGS. 9 and 10. Fixed orifice disk 212 includes a thin body 214 with a central orifice 216. Fixed orifice disk 212 is installed by placement on the inclined wall 210 and is of a dimension to fit securely in relief vent 46. Typically, orifice diameters utilized have diameters in the 0.0120 to 0.0130 inch range.

Fixed orifice disk 212 typically has a thickness in the order of 0.004 inch plus or minus 0.0005 inch and is preferably fabricated using a photo-etching process. The thickness of fixed orifice disk 212 defines the length of orifice 216 and since flow is proportional to the diameter and length of an orifice, the thickness of body 214 can influence the timing and reliability of fixed orifice disk 212.

In the prior art device, the threads of the adjustable contact 54 and the terminal link 56 to contact 50 loosely engage each other. Upon engagement of contact 48 with contact surface 52, the threads of the prior art arrangement shift relative to each other. This shifting results in discontinuity in the thread contact. In addition, it has been discovered that this loose engagement allows oxidation which produces further discontinuity significantly reducing the reliability of these prior art switches.

The present invention provides an electrically reliable contact for switch 10 by maintaining a constant, high mechanical pressure between the threads of adjustable contact 54 and the threads of terminal link 56. This high mechanical pressure is provided by a biasing member which, in the preferred embodiment illustrated, is a lock washer 60 and a slotted lock round nut 62 (FIG. 4). To install this biasing member, adjustable contact 54 is threaded onto terminal link 56 to the desired position and lock washer 60 is mounted on adjustable contact 54. The slotted lock round nut 62 is then threaded on adjustable contact 54 compressing the lock washer 60 and applying mechanical pressure or a positive bias to the threads of the adjustable contact 54 and the terminal link 56. The force or pressure on these threads can be varied by rotational torque applied to round nut 62. The mechanical pressure on the threads prevents the discontinuity experienced in prior art switches.

In keeping with the invention disclosed herein, the switch setting is controlled by pressure, the position of contact surface 52 relative to electrical contact 69 and is adjusted by threading adjustable contact 54 into or out of terminal link 56. This adjustment may be accomplished prior to applying the mechanical pressure on the threads of adjustable contact 54 and terminal link 56 constant by using a tool 64 (FIG. 6). Tool includes a driver member 66. Driver member 66 is defined by a shaft 68 and a blade 70. Blade 70 is configured to fit in a slot 72 formed in a slot 72 in the head 58 contact 54. By rotating shaft 68, blade 70 rotates adjustable contact 54 into or out of terminal link 56, thereby adjusting the position of contact surface 52.

To lock the contact set screw threads in the threads of contact 54 and terminal link 56, a first adjustment of contact 54, tool 64 includes a tubular sleeve 74. Sleeve 74 is inserted into aperture 59. Driver shaft 68 extends through and is free to rotate within sleeve 74. Sleeve 74 includes a pair of fingers 76 configured to fit into slot 77 of lock round nut 62 at locations on opposite sides of adjustable contact 54. Tubular sleeve 74 includes an integral disk 78 that may be gripped while rotating driver member 66. Tubular sleeve 74 can be held stationary while driver member 66 is rotated to adjust the position of contact surface 52 while lock round nut 62 remains stationary.

The present invention provides an electrically reliable contact 54 for switch 10 while maintaining high mechanical pressure between the threads of contact 54 and terminal link 56. In addition, sensitivity of switch 10 can be adjusted while the mechanical pressure on the threads remains constant.

Different devices may be used in the present invention. For example, referring to FIG. 5, there is illustrated a portion of a switch 100 that includes an alternative embodiment of the present invention. Switch 100 is identical to switch 10 and the reference numerals in FIGS. 1–4 appear in FIG. 5 to designate identical components. Switch 100 differs from switch 10 by the substitution of a compressed spring 160 for lock washer 60. Like lock washer 60, compression spring 160 applies mechanical pressure between the threads of adjustable contact 54 and terminal link 56. Tool 64 may also be used on switch 100 to adjust contact 54 in the same manner as previously described.

Many modifications and variations of the present invention are possible in light of the above teachings. Thus, it is to be understood that, within the scope of the appended claims, the invention can be practiced other than as specifically described in the above description.

What is claimed is:

1. In a pressure wave switch for controlling an electrically operated door including a switch housing, a cavity defined in said switch housing, a diaphragm mounted in said cavity, said diaphragm defining first and second chambers in said cavity, an electrical contact in said first chamber on said diaphragm and movable therewith, means for communicating said second chamber to a pressure sensing portion of said door, first and second tapped electrical terminal links mounted in said housing, and a threaded, fixed contact in said first chamber, adjustably threaded into said first tapped terminal link and cooperating with said movable contact to define an electrical switch, and conductor means on said diaphragm electrically communicating said movable contact and second terminal link, the improvement comprising:

means for applying a biasing force between said adjustable contact and said first tapped terminal link to provide a positive thread bias on the threads of said adjustable contact and said tapped terminal link.

2. A pressure wave switch as claimed in claim 1 wherein said biasing force applying means includes a round lock nut on said adjustable contact and a lock washer on said adjustable contact between said round lock nut and said tapped terminal link.

3. A pressure wave switch as claimed in claim 1 wherein said biasing force applying means includes a round lock nut on said adjustable contact and a spring on said adjustable contact between said round lock nut and said tapped terminal link.

4. A pressure wave switch as claimed in claim 1 wherein said adjustable contact includes a slotted end, said biasing force means includes a slotted round lock nut coaxial with and surrounding said adjustable contact, and an adjustment tool, said tool including a blade member and a coaxial tube surrounding said blade member.

5. A pressure wave switch as claimed in claim 4 wherein said coaxial tube includes a pair of diametrically opposed fingers.

6. A pressure wave switch as claimed in claim 4 wherein said blade member is rotatable relative to said coaxial tube.

7. A pressure wave switch as claimed in claim 1 further comprising a relief vent in said second chamber, a fixed orifice disk mounted in said relief vent, said fixed orifice disk including a body with a central orifice in said body.

8. A pressure wave switch as claimed in claim 7 further comprising a plurality of radially extending tabs on said body of said fixed orifice disk.

9. A pressure wave switch as claimed in claim 7 wherein said fixed orifice disk is mounted on an O-ring in said relief vent.

10. A pressure wave switch as claimed in claim 7 wherein said fixed orifice disk is 0.004 inch plus or minus 0.0005 inch thick.

11. A pressure wave switch as claimed in claim 7 wherein said fixed orifice disk is fabricated by a photoetching process.

12. A positive thread biasing assembly with an adjustable contact of a pressure wave switch wherein said pressure wave switch includes a housing, a diaphragm cavity, defined in said housing, a switch diaphragm mounted in this cavity, said diaphragm and cavity defining first and second chambers in said cavity, a contact on said diaphragm in said first chamber and movable therewith, a tapped electrical terminal link mounted in said housing, a fixed contact adjustably threaded into said terminal link and extending at least partially into said first chamber, said fixed and movable contacts cooperating to define an electrical switch in said first chamber, said biasing assembly comprising a round lock nut mounted on said adjustable contact and a biasing element mounted between said round lock nut and said terminal link.

13. A positive thread biasing assembly as claimed in claim 12 wherein said biasing element includes a lock washer.

14. A positive thread biasing assembly as claimed in claim 12 wherein said biasing element includes a spring.

15. A positive thread biasing assembly as claimed in claim 12 wherein said adjustable contact includes a slotted end, said round lock nut being slotted, and an adjustable tool comprising an elongated blade configured for engagement with said slotted end of said adjustable contact, and a tube coaxial with and surrounding said elongated blade, said tube including fingers configured for engagement with slots in said round lock nut, a gripping member on said tube.

16. A positive thread biasing assembly as claimed in claim 15 wherein said elongated blade is rotatable relative to said tube.

17. A method of adjusting the position of an adjustable, threaded contact in a pressure wave switch while maintaining constant a pre-set positive thread bias on threads of said adjustable contact wherein said pressure wave switch includes a housing, a diaphragm switch chamber defined in said housing, a switch diaphragm mounted in said diaphragm switch chamber, a tapped terminal link secured on said housing, said adjustable contact threaded into said terminal link, a round lock nut threaded on said adjustable contact, the steps comprising:

rotating said adjustable contact relative to said terminal link, and holding said round lock nut stationary while rotating said adjustable contact.

18. A method of adjusting the position of an adjustable contact in a pressure wave switch as set forth in claim 17 further comprising the step of applying pressure between said adjustable contact and said terminal link to provide a positive thread bias.

* * * * *